US006401965B1

(12) United States Patent
Lang et al.

(10) Patent No.: US 6,401,965 B1
(45) Date of Patent: Jun. 11, 2002

(54) REFRIGERATING AGENT COMPRESSOR WITH IMPROVED PRESSURE CHAMBER

(75) Inventors: Rudolf Lang, Jennersdorf; Johann Neubauer, Heiligenkreuz, both of (AT)

(73) Assignee: Verdichter Oe. GesmbH, Fürstenfeld (AT)

( * ) Notice: Subject to any disclaimer, the term of this patent is extended or adjusted under 35 U.S.C. 154(b) by 0 days.

(21) Appl. No.: 09/555,033

(22) PCT Filed: Dec. 10, 1998

(86) PCT No.: PCT/AT98/00304

§ 371 (c)(1),
(2), (4) Date: May 23, 2000

(87) PCT Pub. No.: WO99/30038

PCT Pub. Date: Jun. 17, 1999

(30) Foreign Application Priority Data

Dec. 11, 1997 (AT) ..... 775/97 U

(51) Int. Cl.[7] ..... B65D 6/28
(52) U.S. Cl. ..... 220/612; 220/581
(58) Field of Search ..... 220/612, 611, 220/581

(56) References Cited

U.S. PATENT DOCUMENTS

| | | | | | |
|---|---|---|---|---|---|
| 2,335,174 A | * | 11/1943 | Crawford | ..... | 220/612 |
| 3,178,811 A | * | 4/1965 | Fuller | ..... | 220/612 |
| 3,231,343 A | * | 1/1966 | Graham | ..... | 220/612 |
| 4,753,368 A | * | 6/1988 | Lescaut | ..... | 220/612 |

FOREIGN PATENT DOCUMENTS

| | | | | | |
|---|---|---|---|---|---|
| AT | 235199 | * | 8/1964 | ..... | 220/612 |
| DE | 28 26 744 A1 | | 1/1980 | | |
| DE | 36 45 083 C2 | | 2/1988 | | |
| DE | 39 40 617 A1 | | 6/1990 | | |
| EP | 0 745 773 A1 | | 12/1996 | | |
| FR | 1.430.466 | | 1/1966 | | |
| JP | 0142607 | * | 11/1979 | ..... | 220/612 |
| JP | 04-76278 | | 3/1992 | | |
| NL | 6400023 | * | 11/1964 | ..... | 220/612 |
| NL | 0285247 | * | 1/1965 | ..... | 220/612 |

* cited by examiner

*Primary Examiner*—Joseph M. Moy
(74) *Attorney, Agent, or Firm*—Scully, Scott, Murphy & Presser

(57) ABSTRACT

An electric refrigeration compressor, in particular for household refrigerating and deep-freezing appliances, including an outer casing, an inner body, a pressure chamber integrated in said inner body as well as a lid by which the opening of the pressure chamber is closeable, wherein the lid and the pressure chamber are provided with an annular flat rim (5) arranged in the region of the opening of the pressure chamber as well as a corresponding annular flat rim (6) extending about the closing periphery of the lid, wherein the annular flat rims are mutually couplable so as to be connectable in a stable and permanent manner. One of the annular flat rims is provided with a rib projecting against the corresponding annular rim located opposite and has a substantially triangular radial vertical section with an outwardly oriented corner, the angle of such a corner ranging between 70° and 90°. The bottom (E) of said pressure chamber is flat.

6 Claims, 3 Drawing Sheets

REFRIGERATING AGENT COMPRESSOR WITH IMPROVED PRESSURE CHAMBER

Refrigeration compressor with improved pressure chamber The invention relates to a special design of the closing means of the pressure chamber of a hermetic refrigeration compressor provided, in particular, for use in connection with household refrigerating and/or deep-freezing appliances.

It is known to provide such refrigeration compressors with pressure chambers, which are thus called because the refrigerant, after having been compressed by the compressor piston, flows into the same before being conveyed into the pressure duct of the refrigerant cycle.

The main reason for providing such pressure chambers resides in that they substantially fulfill the function of a sound absorber. For constructional reasons, such a sound absorber or pressure chamber is configured with one or several suitable recesses worked out of the cylinder casing of the compressor. Such a sound-absorbing pressure chamber is open on one side. This opening of the pressure chamber is closed by a separate lid which is attached during the assembly of the compressor.

Figure 1:
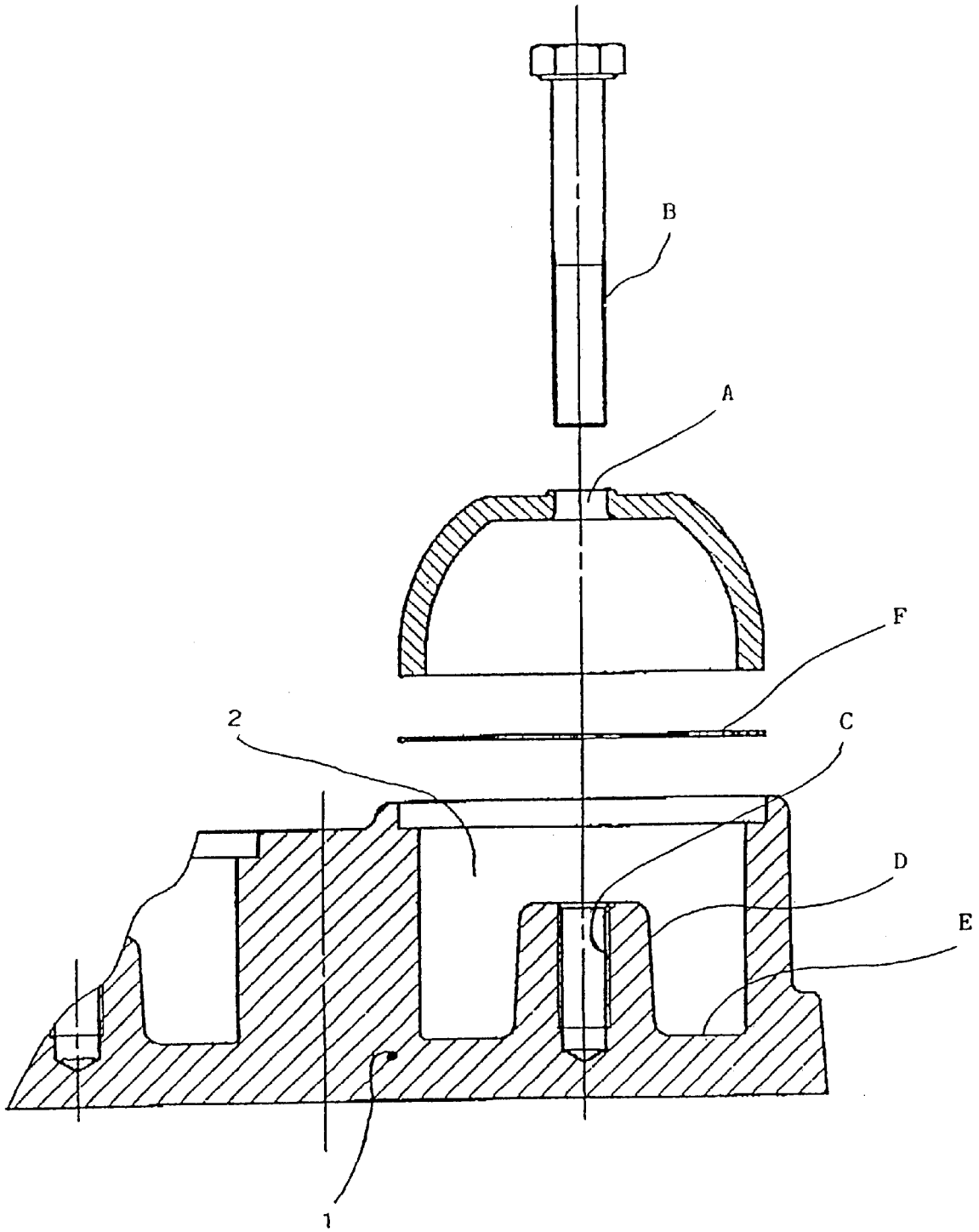

According to the assembly procedure usually employed in accordance with the present state of the art for a lid of this type, the latter is bored through in its central section and a screw or a bolt B is inserted into such a bore A in a manner so as to enable the screw or bolt to be screwed in a respectively provided thread C cut out of an appropriately provided shoulder D which projects from the bottom E of said pressure chamber 2 in a suitable position, as is schematically illustrated in FIG. 1.

However, such a technical solution, even though it actually achieves the set object, involves some disadvantages. Above all, there is the necessity to use two additional structural components beside the already mentioned lid, i.e., the already mentioned screw bolt B and the seal F to be inserted between said lid and the opening of the pressure chamber, as can be taken from FIG. 1. It goes without saying that the use of such additional structural components results in increased costs in terms both of material and manufacture.

The second disadvantage rather refers to functioning, since the presence of said shoulder D and the screw within the pressure chamber will result in a considerable decrease of the volume of the pressure chamber and hence in a reduced sound-absorbing efficacy.

It is, therefore, desirable and, at the same time, the object of the present invention to provide a refrigeration compressor which combines an enhanced sound-absorbing efficacy of its pressure chamber with a general reduction of its manufacturing costs and which, at the same time, is cost-effective and easy to assemble using materials and manufacturing processes usually permitted by the present state of the art. The characterizing features of the invention are defined in more detail in the annexed claims.

Figure 2:
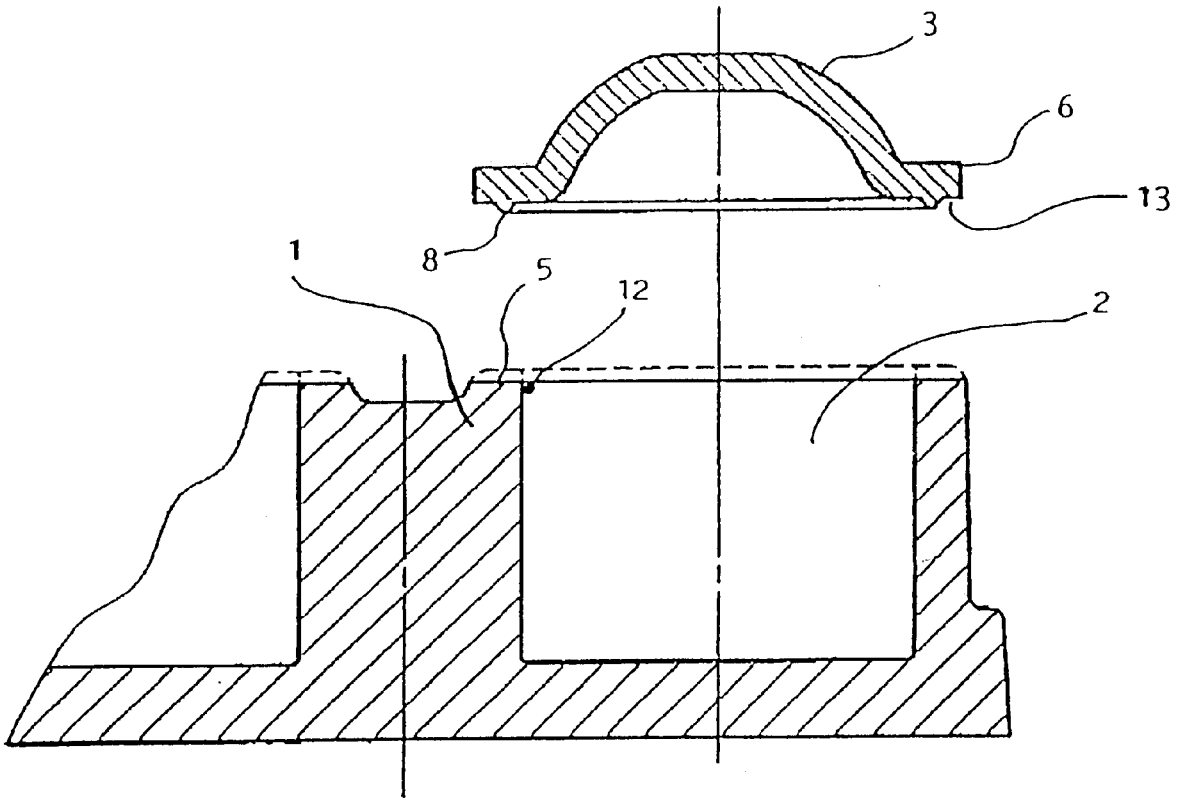
Figure 3:
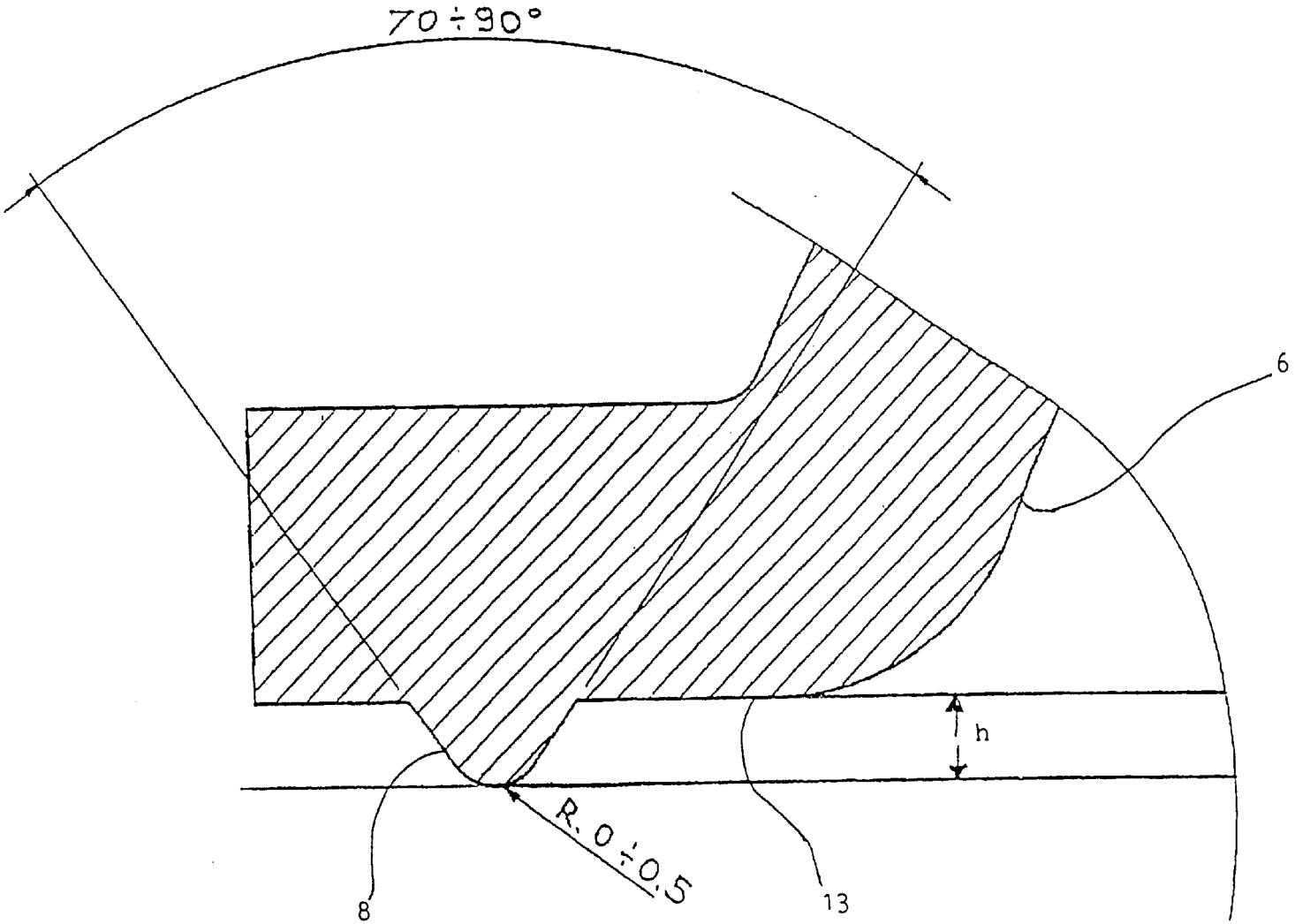

In accordance with the invention, this object is achieved by the technical solutions explained in more detail below in the form of a non-limiting example with reference to the accompanying drawings. Therein, FIG. 1 is a schematic sectional view of the pressure chamber of a refrigeration compressor according to the present state of the art, FIG. 2 is a schematic sectional view of the pressure chamber of a refrigeration compressor according to the present invention, FIG. 3 is an enlarged view of a detail of FIG. 2.

The concept underlying the present invention will be explained in more detail in the following: With reference to the illustration of FIG. 2, it will be noted that the pressure chamber 2, whose opening is closeable by the lid 3, is worked out in the inner body 1 of the compressor, which is not illustrated. The lid has no bore for receiving means that would have to be used for tightly closing the lid against the opening 12 of the pressure chamber. On the contrary, the lid comprises an annular flat external rim 6.

The opening 12 of the pressure chamber, in turn, comprises a corresponding annular flat external rim, wherein the respective dimensions and shapes are chosen such that the lid can be placed on the opening in a manner so as to allow the annular flat external rims to be connected with each other in a non-detachable manner by a material transformation.

In order to attach such a closing means once and for all, the lower surface 13 of the annular rim 6 of the lid is tightly closed relative to the annular rim 5 arranged therebelow, of the opening of the pressure chamber by any means known per se, e.g., by capacitor discharge welding, thereby achieving the desired result.

It goes without saying that the necessity of arranging a shoulder D on the bottom of the pressure chamber for receiving the stud of a screw bolt aimed to fix the lid is obviated by applying the solution according to the invention. Hence follow enhanced manufacturing properties of the pressure chamber as well as an enlargement of its volume, thus ensuring improved sound-absorbing qualities.

It should be added that this solution, at the same time, renders feasible to avoid the use of a seal, since the type of this connection between the lid and the opening of the pressure chamber secures a tight closure even at the high pressures that may prevail within the pressure chamber.

An advantageous improvement in the sense of the present invention, which contributes to facilitating the mutual connection of said annual flat external rims in a suitable manner resides in working out on the inner surface of one of said rims a rib 8 which preferably extends along the inner surface 13 of the rim of the lid in accordance with the representation depicted in FIG. 3 and projects relative to the opposite rim, i.e., is oriented downwards in respect to FIG. 3.

The purpose of such a rib is the formation of a defined line contact which is necessary for problem-free welding, since it is well known that the weld joint between two flat surfaces involves some problems due to scattered heat and difficulties of orientation.

In order to improve the concentration of the welding heat and the joinability, it is suitable if such a rib, which follows the annular section of the respective rim, has a substantially triangular cross section, wherein the lower rim angle a must be between 70° and 90°.

It has, furthermore, been shown that such a rib must have a height h of between 0.2 and 1.2 mm with a view to optimizing the junction between said rims.

It will readily be appreciated that the above description and explanations have been indicated merely as a non-limiting example for elucidating the invention and that various alternatives and modifications may be envisaged without leaving the scope of protection of the present invention.

What is claimed is:

1. An electric refrigeration compressor, in particular for household refrigerating and deep-freezing appliances, including an outer casing, an inner body contained within said outer casing, a pressure chamber integrated in said inner body as well as a lid by which an opening of said pressure chamber is closed, the lid having a closing periphery, the lid and the pressure chamber are provided with means to retain the lid in a closed position, an annular flat rim arranged in a region of the opening of the pressure chamber as well as a mutually corresponding annular flat rim extending about the closing periphery of said lid, the annular flat rims are mutually coupled along a common annular line of contact, wherein, one of the (a) annular flat rim arranged in the opening of the pressure chamber and (b) annular flat rim that extends about the closing periphery of said lid, is provided with a rib projecting against said mutually corresponding rim.

2. An electric refrigeration compressor, in particular for household refrigerating and deep-freezing appliances, including an outer casing, an inner body contained within said outer casing, a pressure chamber integrated in said inner body as well as a lid by which an opening of said pressure chamber is closed, the lid having a closing periphery, the lid and the pressure chamber are provided with means to retain the lid in its closed position, an annular flat rim arranged in a region of the opening of the pressure chamber as well as a mutually corresponding annular flat rim extending about the closing periphery of said lid, the annular flat rims are mutually coupled along a common annular line of contact, the rim extending about the closing periphery of said lid provided with a rib projecting against the corresponding rim that extends about the opening of said pressure chamber, wherein the rib has a substantially triangular radial vertical section with an outwardly oriented corner, the corner defining an angle, the angle of the corner ranging between 70° and 90°.

3. An electric refrigeration compressor according to claim 1 or 2, wherein said common angular line of contact is connected by a continuous weld.

4. An electric refrigeration compressor according to claim 1 or 2, wherein no seal is inserted between said annular flat rims such that said rims are in direct contact with each other.

5. An electric refrigeration compressor according to claim 4, wherein said pressure chamber has a flat bottom.

6. An electric refrigeration compressor according to claim 2, wherein said rib has a height from the respective annular flat rim, said height ranging between 0.2 and 1.2 mm.

* * * * *